United States Patent [19]

Teich

[11] 4,335,290

[45] Jun. 15, 1982

[54] MICROWAVE OVEN BLOWER RADIATOR

[75] Inventor: Wesley W. Teich, Wayland, Mass.

[73] Assignee: Raytheon Company, Lexington, Mass.

[21] Appl. No.: 69,479

[22] Filed: Aug. 24, 1979

Related U.S. Application Data

[63] Continuation of Ser. No. 866,970, Jan. 5, 1978, abandoned.

[51] Int. Cl.[3] ..... H05B 6/72

[52] U.S. Cl. ..... 219/10.55 F; 219/10.55 R; 219/10.55 E; 219/400

[58] Field of Search ..... 219/10.55 F, 10.55 R, 219/10.55 M, 10.55 D, 10.55 E, 400, 10.55 B

[56] References Cited

U.S. PATENT DOCUMENTS

| | | | |
|---|---|---|---|
| 2,408,331 | 9/1946 | Mills | 219/400 |
| 2,961,520 | 11/1960 | Long | 219/10.55 F |
| 3,440,385 | 4/1969 | Smith | 219/10.55 F |
| 3,692,967 | 9/1972 | Hashimura | 219/10.55 M |
| 3,746,823 | 7/1973 | Whiteley | 219/10.55 F |
| 3,920,944 | 11/1975 | Constable | 219/10.55 M |
| 3,991,295 | 11/1976 | Akiyoshi | 219/10.55 F |
| 4,028,521 | 6/1977 | Uyeda et al. | 219/10.55 F |
| 4,037,071 | 7/1977 | Kaufman, Jr. et al. | 219/10.55 F |

FOREIGN PATENT DOCUMENTS

| | | | |
|---|---|---|---|
| 1440333 | 4/1969 | Fed. Rep. of Germany | 219/10.55 F |
| 2312165 | 12/1976 | France | 219/10.55 F |
| 45-32474 | 10/1970 | Japan | 219/10.55 F |

*Primary Examiner*—B. A. Reynolds
*Assistant Examiner*—Philip H. Leung
*Attorney, Agent, or Firm*—William R. Clark; Milton D. Bartlett; Joseph D. Pannone

[57] ABSTRACT

A microwave heating system having a combination rotary blower and multiport microwave radiator positioned in a cavity and having radiating ports at different distances from the axis of rotation which direct overlapping radiation patterns at a body to be heated. A combination heater may be used having a resistive heater positioned in regions around the outside of the rotary structure to supply heat to the body.

10 Claims, 6 Drawing Figures

MICROWAVE OVEN BLOWER RADIATOR

CROSS-REFERENCE TO RELATED CASES

This is a continuation of application Ser. No. 866,970, filed Jan. 5, 1978, now abandoned.

CROSS-REFERENCE TO RELATED APPLICATIONS

Copending application Ser. No. 754,064 filed Dec. 23, 1976, now abandoned by the same inventor as this application and assigned to the same assignee as the present application, is hereby incorporated by reference and its disclosure made a part of this application.

BACKGROUND OF THE INVENTION

Microwave ovens have used cavities containing mode stirring structures to provide varying electric field patterns in the cooking area of the oven by introducing microwave energy into a cavity, which generally has interior dimensions large with respect to a wavelength of the microwave frequency, and moving conductive elements in the cavity to reflect the energy and vary the patterns so that points of maximum voltage gradients are continuously shifted in the cavity to more uniformly heat different sizes and shapes of bodies.

A reflective mode stirrer, which is designed for one set of load conditions such as heating hamburgers or hot dogs, does not produce the same effectiveness in uniformly heating a large body such as a roast or a wide relatively planar body such as a pie. Also in microwave ovens having hot air circulated through the oven to cook the food surface, it is desirable to utilize a blower for blowing the hot air at uniform rates past the surface of the food body while subjecting the food body to radiated microwave energy.

SUMMARY OF THE INVENTION

In accordance with this invention, a plurality of radiation patterns supplying direct radiation to a food body are formed by a rotating radiating structure which simultaneously acts as a centrifical blower to blow energy toward the walls of the cavity, thereby circulating the air past the food body. The air may then be blown over a resistance heater to heat the air to temperatures in the range of 100° to 300° C., the temperature being selected by selecing the amount of power supplied to the resistance heater.

In accordance with the present invention, there is provided a microwave oven in which a rotating radiator provides for stirring the air in the oven to circulate the air past a food body being heated by microwave energy.

This invention further provides for a centrifugal blower positioned in the back of the cavity blowing air against the walls of the cavity to circulate air around the cavity.

This invention further provides for blowing air past a heater positioned in the microwave heating cavity for heating the air to be circulated past the food body.

This invention further provides for feeding microwave energy into the cavity coaxially along the shaft rotating the blower and using the blower structure to distribute the microwave energy into the cavity in a predetermined pattern which rotates with the blower.

This invention further provides for the blower to be driven by a motor positioned outside the cooking cavity through a structure comprising a shaft extending through a microwave energy seal and forming the central conductors of a microwave transmission line structure supplying microwave energy to the cavity.

An embodiment of this invention provides for supplying energy through ports in a wall substantially perpendicular to the axis of rotation of said blower with said port being spaced at different distances from a coaxial feed to said blower and with the polarization of the energy from said ports being at different angles with respect to each other. More specifically, the ports are preferably positioned on radii of said axis which are spaced apart by 120° to form a three-phase radiation system, the magnitude of the power radiating from each port being shown from the dimensions of the radiating port to produce the desired mode pattern directed toward a body positioned in the oven to produce a structure in which reflected energy from the walls of the heating cavity re-enters the rotating radiator to produce substantial cancellation at the coaxial microwave feed to the radiator.

BRIEF DESCRIPTION OF THE DRAWINGS

Other and further objects and advantages of this invention will become apparent as the description thereof progresses, reference being had to the accompanying drawings wherein.

DESCRIPTION OF THE PREFERRED EMBODIMENT

Figure 1:
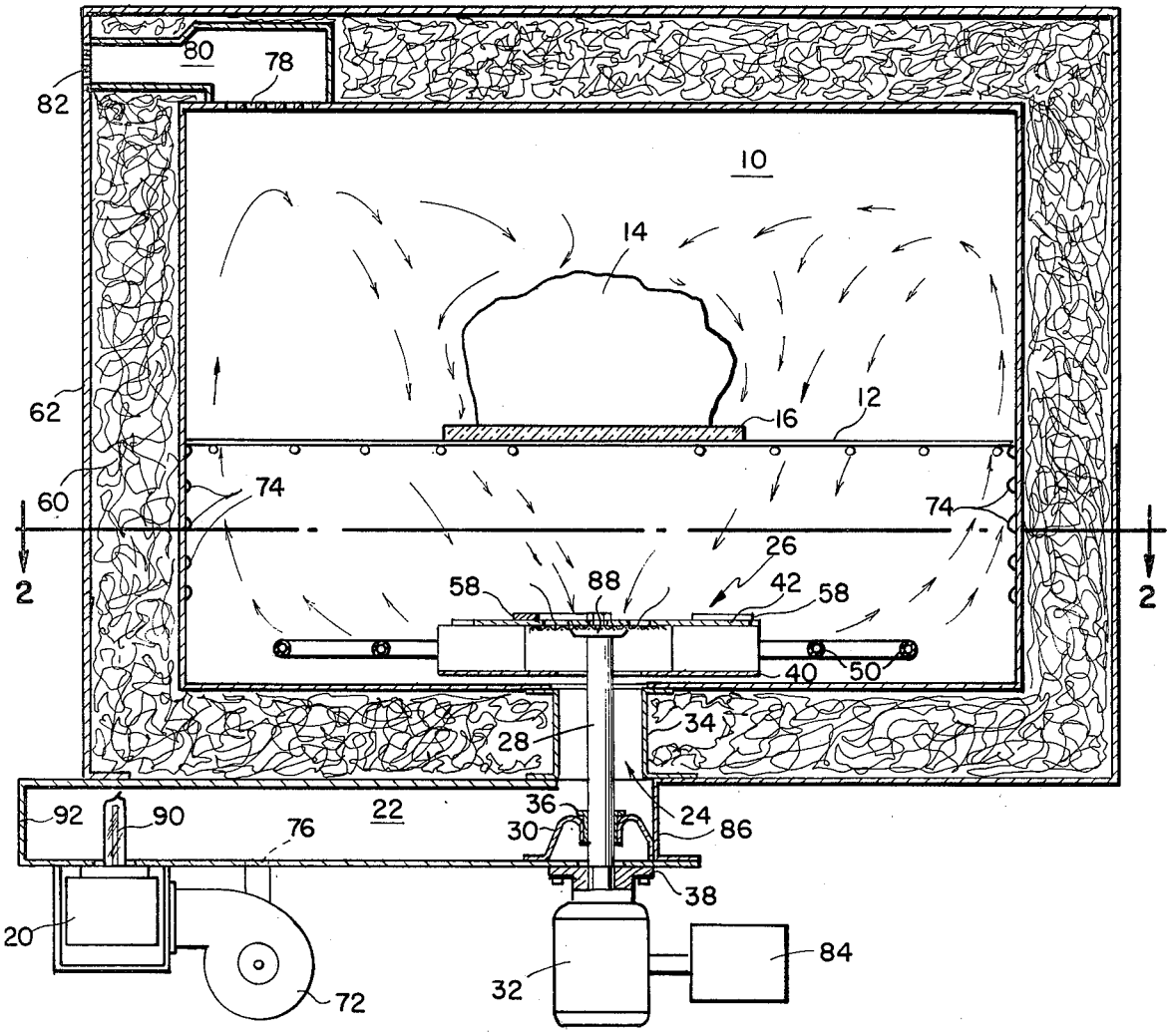
FIG. 1 illustrates a vertical sectional view of a microwave oven embodying the invention taken along line 1—1 of FIG. 2.
Figure 2:
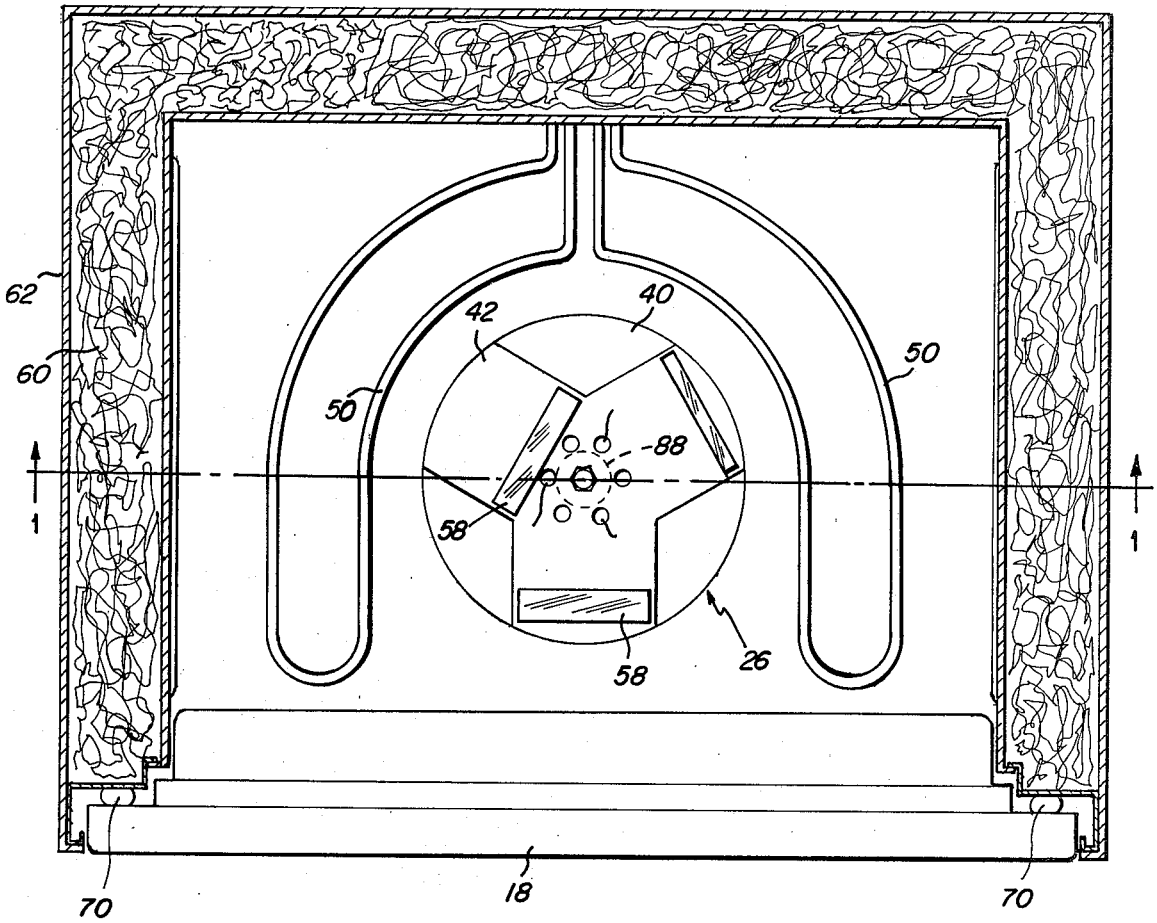
FIG. 2 illustrates a transverse sectional view of the oven of FIG. 1 taken along line 2—2 of FIG. 1.
Figure 3:
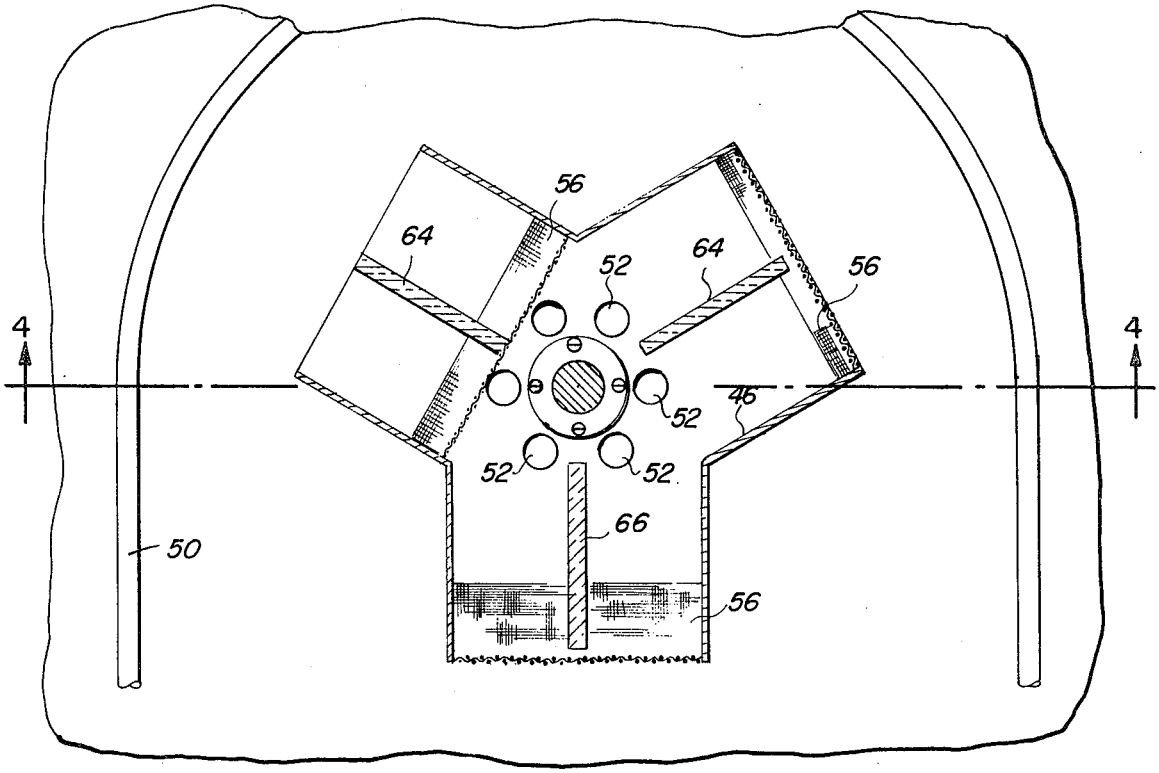
FIG. 3 illustrates an enlarged horizontal sectional view of the rotating radiator structure of FIGS. 1 and 2 taken along line 3—3 of FIG. 4.
Figure 4:
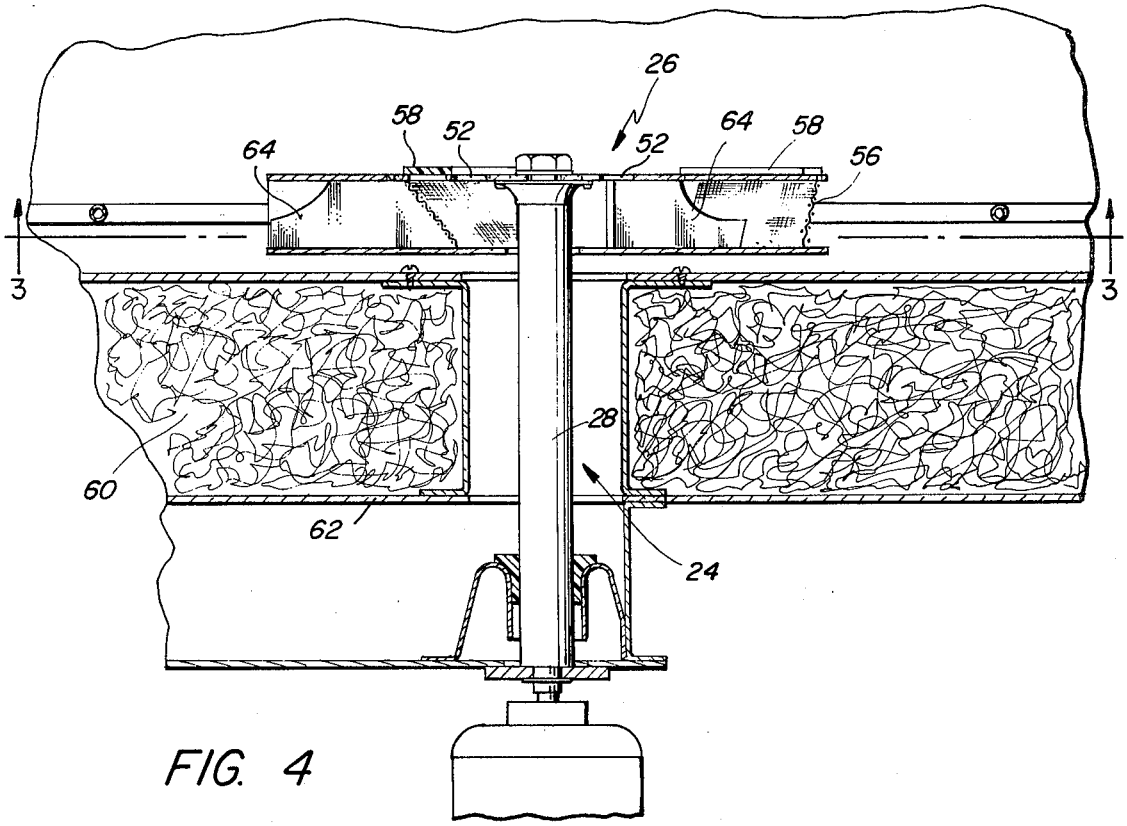
FIG. 4 illustrates an enlarged vertical sectional view of the structure of FIG. 3 taken along line 4—4 of FIG. 3.

Referring now to FIGS. 1 through 4, there is shown a microwave oven comprising a conductive cavity 10 containing a rack of open metal bars 12 supporting a food body 14 on a ceramic support member 16. A door 18 closes an access aperture to the enclosure 10.

Energy is supplied by a magnetron 20 through a waveguide 22 and a coaxial feed 24 to the interior of the enclosure 10 through a radiating structure 26 which also acts as a centrifugal blower. Radiating structure 26 is supported on the central conductor 28 of coaxial structure 24 which extends through a matching structure 30 on the bottom wall of waveguide 22 and is connected to a motor 32 which rotates member 28. An outer conductor 34 of coaxial line 24 is connected between an aperture in the upper wall of waveguide 22 and an aperture in the wall of enclosure 10 surrounding conductor 28 which is rotated by motor 32. An insulating busing 36 between metal transition member 30 and member 28 prevents touching of these members and provides a choke structure for microwave energy which might otherwise permit microwave energy to leak from waveguide 22 along conductive shaft 28 toward the motor 32. The motor 32 is rigidly supported from the waveguide 22 by a bracket 38. Blower radiating structure 26 comprises a bottom plate 40 having an aperture therein approximately the same size as outer conductor 34 and is spaced slightly from the bottom wall of enclosure 10 but substantially inhibits the transmission of microwave energy into the oven through the space between plate 40 and said bottom wall. An upper plate 42 is rigidly connected to conductor 28 and is connected to bottom plate 40 by partition members 46 which also act as fan blade members so that upon rotation of radiating pattern structure 26 air is driven radially outwardly and impinges upon radiating heating elements 50 which heat the air and circulate the air in the oven past food body 14.

Air is drawn into radiating structure 26 through apertures 52 such as holes whose diameters are substantially less than a half wavelength of the microwave energy and, hence, preclude the radiation of energy therethrough.

The radiating structure 26 is made to radiate microwave patterns upwardly toward the food body 14 by blocking the peripheral ends of the waveguides formed partitions 46 with screens 56 which allow the passage of air but which reflect microwaves upwardly through ceramic members 58 which are transparent to microwave energy. As shown, the three radiating patterns rotate to form toroids having different average diameters in the heating cavity because of the different distances of the radiating ports, covered by microwave transparent members 58, from the axis of rotation of the structure 26. However, more than three such patterns could be used to achieve uniformity of radiation of the food body.

Because heated air is used in the oven, it is insulated with thermal material 60 held in place by an outer skin 62 so that optimum efficiency of heating the food body may be achieved. While this system is preferably used with a microwave frequency of 2.45 KMh, other frequencies such as 0.915 KMh can be used.

As illustrated herein, additional paddle elements 64 may be positioned beyond the screens 56 for additional blower action if desired and additional paddle members 66 of material which is transparent to microwave energy such as plastic may be used in the regions between the conductor 28 and the screens 56, the exact size and spacing of members 64 and 66 being selected dependent upon the quantity and velocity of air circulation desired.

Preferably, shaft 28 is rotated at a rate between 200 and 1,000 rpm with higher speeds being possible.

In operation, a food body 14 is placed in the oven; door 18 is closed and sealed to the oven wall by a conventional high temperature vapor seal 70 which may be, for example, hollow wire braid covered with a sheath of braided fiberglass. An electric voltage is then supplied to the resistance heaters 50 which may be, for example, conventional nichrome wire positioned inside a metal sheath and insulated therefrom by ceramic so that the sheath heats the air. Motor 32 is simultaneously energized and circulates the air past the heaters 50 and over the surface of the food body 14. After a few seconds, the magnetron 20 is energized, along with its air cooling blower 72, to supply microwave energy through waveguide 22 and radiating member 26 to the oven interior 10 to radiate substantial portions of the energy directly into food body 14 through the apertures in support grill 12 and ceramic support 16 on which the food body 14 rests. If desired, the food body 14 may be positioned in a dish transparent to microwave energy which is positioned on support 16. The proportion of microwave energy radiated directly into the body 14 may be adjusted by adjusting the level of rack 12 above the radiator 26. As shown, the rack is supported by bumps 74 formed on the walls of the enclosure 10 as in conventional ovens, and the rack 12 may be slid out of the oven when the door is opened.

A small amount of air is bled from blower 72 through a small aperture 76 into waveguide 22 to add fresh air to the interior of oven 10 to replace air which is exhausted through a screened aperture 78 to a vapor processing cartridge 80 positioned between the oven 10 and the outer skin 62 so that clean air is exhausted from the cartridge 80 from the aperture 82 to the exterior of the oven system. Since the rate of heat applied to the oven through food body 14 by microwave energy is independent of the rotation of structure 26, the speed of motor 32 may be controlled by a motor speed control 84 to vary the rate of circulation of the air.

Matching of the impedances between the waveguide 22 and the structure 24 improved the positioning of conductive end termination 86 of the guide 22 beyond the matching structure 30. An additional matching collet 88 is positioned around the upper end of conductor 28 to assist in matching the impedance of the structure 24 to the radiator 26.

In practice, the energy coupled into the radiating structure 26 by the conductor 28 excites waves in the TEM mode which travel radially outwardly along the three waveguides whose widths are on the order of a wavelength. The waves are radiated into the cavity through the transparent members 58 as the reflection from the screens 56. The polarization of said waves are at approximately 120° to each other and the phase of each of the waves from its point of radiation from conductor 28 is different. As a result, while substantially all of the microwave energy fed from waveguide 22 through coaxial line 24 to the radiating structure 26 is radiated into the interior of the oven, those portions of the energy which are reflected from the interior of the oven and come back into the radiating structure 26 to excite TEM waves which impinge on conductor 28 with different phases resulting in substantial cancellation of such waves, hence producing reflection back into the heating cavity. As a result, the non-resonant coupling structure of the waveguide 22 and 34 does not produce excessive transmission of reflected energy into the magnetron 20 which could overheat the magnetron or produce undesirable arcing conditions. This, in turn, permits the use of a magnetron whose internal coupling structure is chosen for high efficiency and for matching the magnetron into the waveguide 22 by means of the magnetron output structure 90 and the position of an end plate 92 on the opposite end of the waveguide from the end plate 86. As illustrated herein, the width of the waveguides and the length of the transparent regions 58 are made slightly greater than the waveguide cut-off and may be, for example, $\frac{3}{4}$ to 5/4 of a free space wavelength of the microwave frequency. The width of the coupling apertures 58 determines the relative amount of energy coupled into the oven from each aperture and such widths are preferably made different to produce the overall desired cooking pattern. In general, such a cooking pattern preferably is more intense in the interior region closer to the axis of the radiating structure 26 to direct substantial energy into the interior of the body 14 when hot air is used in conjunction with the microwave energy to heat the food body.

DESCRIPTION OF THE ALTERNATE EMBODIMENT

Figure 5:
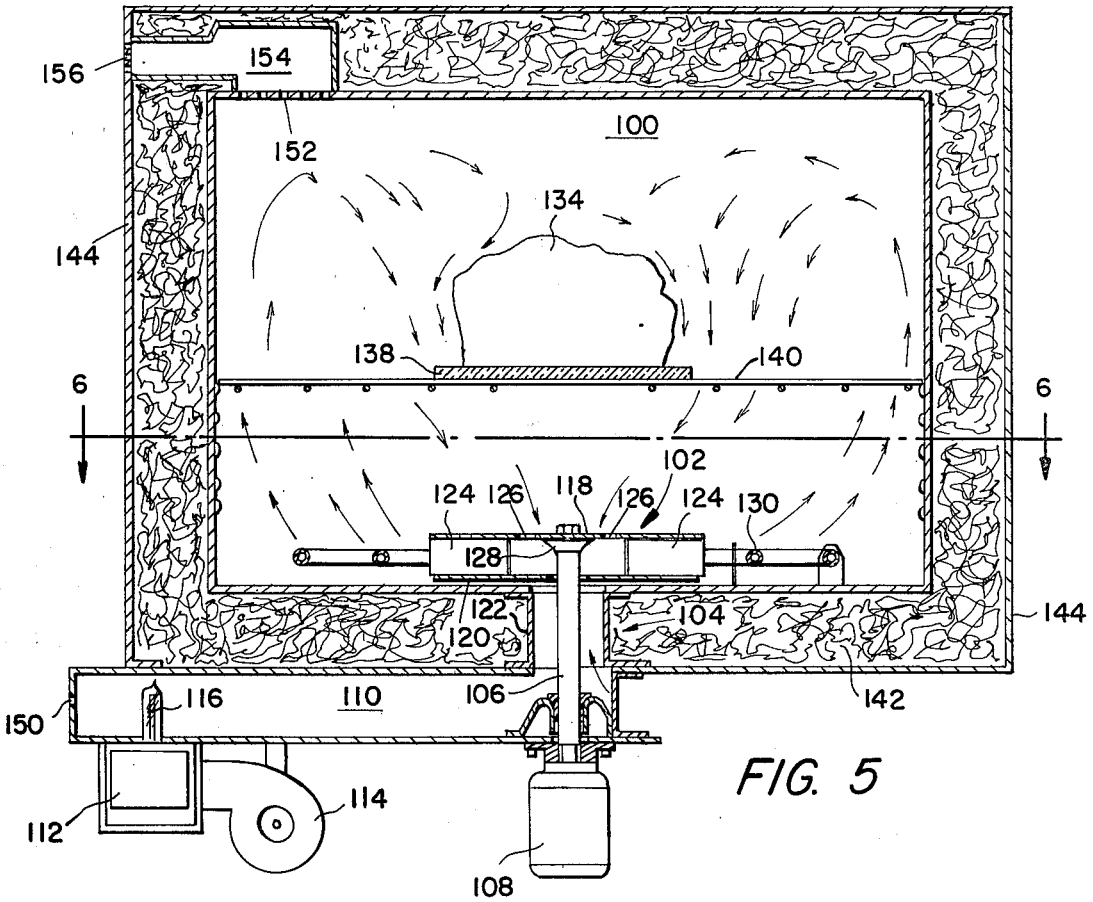
FIG. 5 illustrates a vertical sectional view of an alternate embodiment of the invention taken along line 5—5 of FIG. 6.
Figure 6:
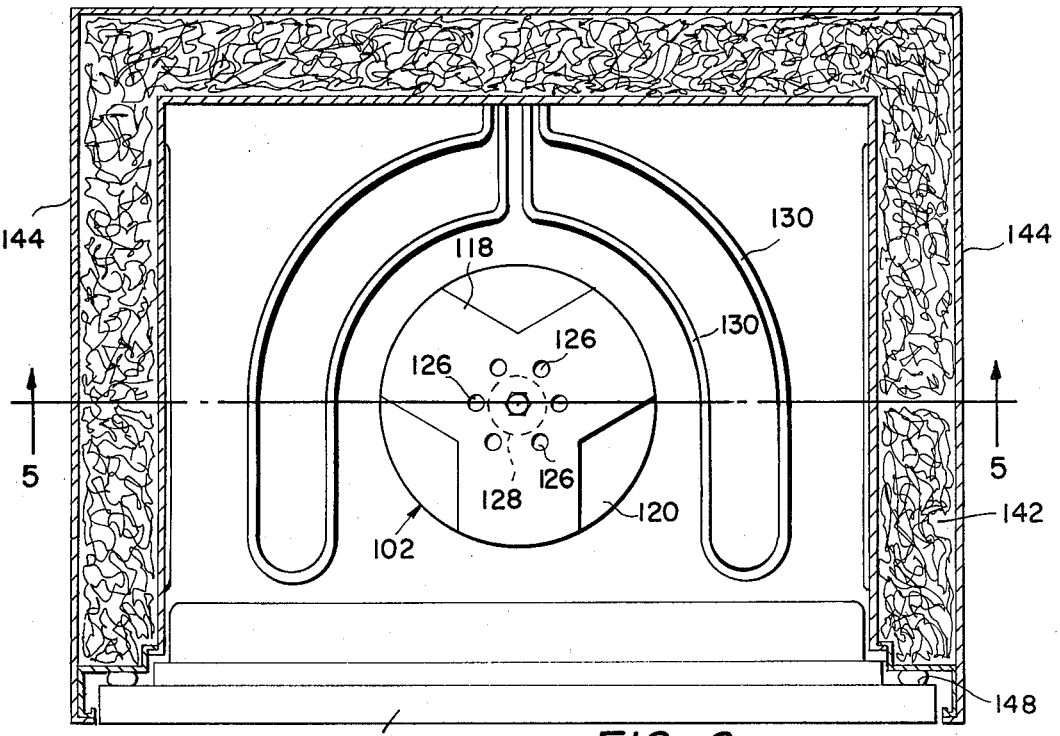
FIG. 6 illustrates a transverse sectional view of the embodiment of the invention illustrated in FIG. 5 taken along line 6—6 of FIG. 5.

Referring now to FIGS. 5 and 6, there is shown an alternate embodiment of the invention wherein an enclosure 100 has a radiating structure 102 fed from a coaxial structure 104 extending through the back wall of oven 100. The central conductor 106 of structure 104 is rotated by a motor 108 positioned below a waveguide 110 which couples energy to radiating structure 102 in a manner similar to that described in connection with FIGS. 1–4. Waveguide 110 is supplied with microwave energy by a magnetron 112 whose anode is cooled with air from a blower 114 and has an output structure 116 extending into waveguide 110.

Radiator structure 102 consists of a flat plate 118 connected to conductive shaft 106 which in turn is connected to a second plate 120 parallel thereto and spaced between plate 118 and back wall of enclosure 100. Plate 120 has an aperture therein surrounding shaft 106 of approximately the same diameter as the outer conductor 122 of the coaxial structure 104 and is attached to plate 118 by waveguide wall sections 124 extending radially outwardly toward the periphery of the plates 118 and 120 along axes approximately 120° from each other. Waveguides 124, as illustrated herein, are of substantially the same length and for open ends at the periphery of discs of plates 118 and 120. Apertures 126 in plate 118 having dimensions less than the cut-off frequency of the microwave energy in oven 100 are positioned adjacent the point of connection of shaft 106 to plate 118 through impedance matching and supporting member 128. As a result, when structure 102 is rotated by motor 108, air is moved radially outwardly along waveguide walls 124 by centrifugal action drawing air in through apertures 126 and urging it out toward side, top, and bottom walls of the enclosure 100. Heating elements 130, generally of the type described in connection with FIGS. 1–4, are mounted spaced from the floor of the enclosure 100 so that air moving radially outwardly from the structure 102 passes over such heating elements to heat the air. Preferably such heating elements are positioned a half wavelength or more away from the periphery of plates 118 and 120 so that reflection of energy from these elements back into the waveguide members is minimized.

In accordance with this invention, microwave energy is directed into the cavity 100 primarily by reflection from the walls of the cavity 100. Since three waveguide radiators positioned at 120° angles to each other are radiating into a four-sided enclosure at any given time, energy reflected from a wall directly into one of the waveguides is at a different distance from conductor 106 than the other two waveguide ends. Hence, energy from direct reflection from the side walls and top and bottom walls of enclosure 100 will have substantial portions thereof cancelled by arriving at different phases at conductor 106. As a result, coupling of the magnetron 112 to the interior of the oven may also be optimized for high efficiency with low standing waves in the waveguide 110 of the coaxial feed structure 104. In such a structure, a food body 134 may be supported in a dish 136 on ceramic plate 138 resting on a rack 140 and the air, circulated by the rotating structure 102 over the heating elements 130, is also circulated past the food body 134 to heat and/or condition the food body.

The enclosure 100 is preferably surrounded by insulation 142 held in place be an outer skin 144.

A door 146 is provided for access to the oven interior having a heat seal 148 like that of FIGS. 1–4. If desired, additional air may be bled from blower 114 directly into waveguide 110 through and aperture 150 and an exhaust port provided at 152 through a vapor processing canister 154 to a port 156 in skin 144.

While controls for the embodiment of the invention herein are not shown, they preferably consist of timers of a timing system for determining the on-off times of microwave energy and the intensity of the heat provided by the heating walls and/or the speed of the motor 108.

This completes the description of the embodiments of the invention illustrated herein. However, many modifications thereof will be apparent to persons skilled in the art without departing from the spirit and scope of the invention. For example, ceramic supported structures could be used for portions of the radiating structure 26 and 102 and such structures could be monopoles or dipoles fed by the coaxial structures 24 and 104. Separate blower motors or fan structures could be used and the resistance heating elements could be located at regions isolated from the microwave heating cavities. Accordingly, it is intended that this invention be not limited by the particular details illustrated herein except as defined by the appended claims.

What is claimed is:

1. In combination:

a microwave oven comprising a metallic enclosure supplied with microwave energy through a coaxial line coupled through a wall of said enclosure to a rotating microwave energy radiator in said enclosure;

a resistive heating element in said enclosure;

means for circulating air heated in said oven by said resistive heating element, said circulating means comprising means rigidly connected to said rotating radiator for blowing said air past said resistive heating element;

said radiator being supplied by said microwave energy from a magnetron through said coaxial line, the central conductor of said coaxial line supporting said radiator, said radiator being rotated by said central conductor; and said radiator comprising a plurality of radiating elements simultaneously radiating separate patterns of microwave energy into said enclosure.

2. The combination in accordance with claim 1 wherein said radiating elements are positioned at different radial distances from said central conductor.

3. The combination in accordance with claim 2 wherein said radiating elements comprise slot antennae.

4. The combination in accordance with claim 3 wherein said slot antennae are covered with dielectric material.

5. The combination in accordance with claim 1 wherein said circulating means comprises an air foil.

6. In combination:

a conductive cavity;

a source of microwave energy comprising a magnetron;

a radiating structure positioned in said cavity;

said structure being supported by the central conductor of a coaxial line extending through a hole in a wall of said cavity, said conductor coupling said microwave energy from said source to said structure;

the interior dimensions of said cavity being substantially greater than the free space wavelength of the predominant frequency of said energy;

a resistive heating element in said cavity;

said structure comprising a plurality of radiating elements;

means for rotating said central conductor wherein said structure is also rotated; and means in said cavity and rigidly connected to said radiating structure for forcing air by rotation of said structure past said resistive heating element.

7. The combination in accordance with claim 6 wherein said radiating elements are positioned at different radial distances from said central conductor and provide a plurality of energy patterns having different polarizations.

8. The combination in accordance with claim 6 wherein said radiating elements comprise slot antennae.

9. The combination in accordance with claim 8 wherein said slot antennae are covered with dielectric material.

10. The combination in accordance with claim 6 wherein said forcing means comprises an air foil.

* * * * *